US005132645A

United States Patent [19]

Mayer

[11] Patent Number: 5,132,645

[45] Date of Patent: Jul. 21, 1992

[54] WIDE-BAND BRANCH LINE COUPLER

[76] Inventor: Bernd Mayer, Wallgraben 46, App. 27, DE-2100, Hamburg 90, Fed. Rep. of Germany

[21] Appl. No.: 614,091

[22] Filed: Nov. 15, 1990

[30] Foreign Application Priority Data

Nov. 15, 1989 [DE] Fed. Rep. of Germany ..... 3937973

[51] Int. Cl.[5] ..... H01P 5/22

[52] U.S. Cl. ..... 333/109; 333/112; 333/116; 333/120

[58] Field of Search ..... 333/109, 112, 116–118, 333/120

[56] References Cited

U.S. PATENT DOCUMENTS

| | | | |
|---|---|---|---|
| 3,731,217 | 5/1973 | Gerst et al. | 333/117 X |
| 4,127,831 | 11/1978 | Riblet | 333/116 X |
| 4,305,043 | 12/1981 | Ho et al. | 330/53 |
| 4,371,982 | 2/1983 | Hallford | 455/327 |
| 4,893,098 | 1/1990 | Seely et al. | 333/118 X |

OTHER PUBLICATIONS

Patin, U.S. Statutory Invention Registration, Reg. No. H880, published Jan. 1, 1991, which filed on Feb. 28, 1989.

Paul et al., "Broadband Branchline Coupler for S Band", Elec. Letters, vol. 28, No. 15, Jul. 18, 1991, pp. 1318, 1319.

*Primary Examiner*—Robert J. Pascal
*Assistant Examiner*—Seung Ham
*Attorney, Agent, or Firm*—Sixbey, Friedman, Leedom & Ferguson

[57] ABSTRACT

A four-port wide-band branch line coupler which distributes, to two output ports and over a wide bandwidth, a signal that is fed into an input port at any constant ratio with a phase difference of 90°, so that no power emanates from an isolated port. If a signal is fed into the isolated port, this power is also distributed to both output ports, so that no power emanates from the input port. The coupler has two identical rings consisting of quarter-wave length line sections that are connected by two half-wave length line sections and are connected, by series circuits made of half-wave length line sections with individual branch circuits connected in parallel to them, to the four ports. The circuit can be dimensioned for construction in microstrip technology or coaxial cable technology. Further, the circuit can be made of concentrated elements so that it can be used in microwave monolithic integrated circuits.

12 Claims, 11 Drawing Sheets

WIDE-BAND BRANCH LINE COUPLER

BACKGROUND OF THE INVENTION

The invention relates to a wide-band branch line coupler, in particular for operation in the microwave and millimeter wave range, which, as a so-called double symmetrical four port coupler matched on all sides, distributes a signal fed in by a first port in any ratio that is constant over the entire bandwidth to a second and third port with a phase difference of 90°, so that no power emanates from the remaining fourth port, i.e., it is isolated.

U.S. Pat. No. 4,305,043 to Ho et al. and No. 4,371,982 to Hallford show microwave branch line couplers.

SUMMARY OF THE INVENTION

A primary object of the invention is to avoid the above-noted limitations on the matching of the input port and the isolation of the isolated port.

A further object of the invention is to make a coupler that can be dimensioned so that any power distribution, constant over a wide bandwidth, can be achieved at the output ports.

Another object of the invention is to provide a coupler for use in integrated circuits, in particular in the microwave and millimeter wave range, which can be produced in very small integrated form.

Yet another object of the invention is to provide a novel and improved wide-band branch coupler having two rings that form a double symmetrical four port coupler.

These objects and others that will be apparent from a reading of the claims in conjunction with the specification are achieved in the preferred embodiment of a wide-band branch line coupler in accordance with the present invention in which the four ports consist of two identical rings made each of four line sections of length $\lambda_o/4$, where the wavelength at midband frequency $f_o$ is designated by $\lambda_o$, such that two opposite line sections exhibit characteristic impedances Z2, and each of the other two line sections exhibits characteristic impedances Z1, Z3 that are cascaded over two line sections of length $\lambda_o/2$ with characteristic impedance Z4 so that an inner mesh of four line branches with alternating characteristic impedances Z1 and Z4 results and, for each ring, both connection nodes of the line branches with characteristic impedances Z2 and Z3 are connected to ports while maintaining double symmetry by a cascade consisting in each case of half-wavelength-long line sections and consisting in the simplest case of only one line section each.

Optionally, to each set of one or more connection nodes, either between the line sections of length $\lambda_o/2$ or between the last line sections of length $\lambda_o/2$ with the ports, there is connected in parallel a cascade consisting of an even number of line sections one-quarter wavelength long, and the last of these line sections, having length $\lambda_o/4$, forms an open circuit on the exposed end or a cascade consisting of an uneven number of line sections one-quarter wavelength long, with the last line section of these, having length $\lambda_o/4$, being short-circuited on the exposed end.

The present invention will be explained in more detail below based on FIGS. 1–12, and the advantages achieved will be indicated. All embodiments were dimensioned for connection lines with a characteristic impedance of 50 ohms with a commercially available microwave software package The midband frequency is designated by $f_o$. Correspondingly, the wavelength at $f_o$ is designated by "$\lambda_o$".

DETAILED DESCRIPTION OF THE PREFERRED EMBODIMENTS

Figure 1:
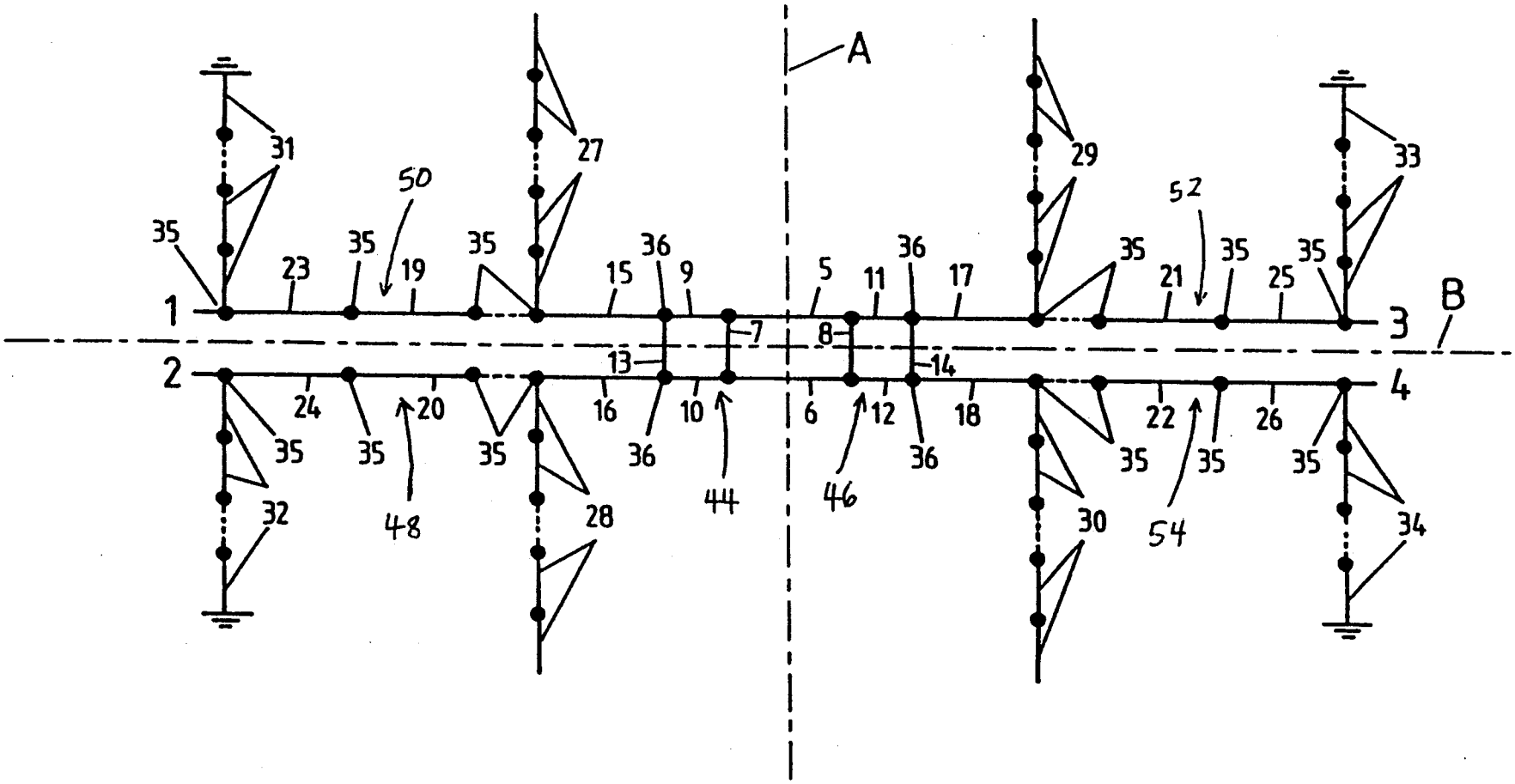
FIG. 1 is a diagrammatic representation of the wide-band branch line coupler of the present invention.

FIG. 1 shows a diagrammatic representation of the wide-band branch line coupler according to the present invention. The wide-band branch line coupler as shown is symmetric with respect to both planes of symmetry A and B. Because of the assumed double symmetry of the network, it is sufficient for dimensioning purposes to indicate only the values for a fourth of the circuit in each case.

As shown in FIG. 1, a wide-band branch line coupler for operation in the microwave and millimeter Wave range is provided with a double symmetrical four port, matched on all sides. The wide-band branch line coupler distributes a signal fed in by a first port 1 in any ratio that is constant over the entire bandwidth to a second port 2 and a third port 3 with a phase difference of 90°, so that no power emanates from the remaining fourth port 4, i e , so that fourth port 4 is isolated. The four port comprises two identical rings 44 and 46, each made from four line sections of length $\lambda_o/4$. The rings 44 and 46 are made respectively from line sections 9, 7, 10, 13, and line sections 11, 8, 12, 14.

Two opposite line sections in each ring 44 and 46, (9 and 10, and 11 and 12, respectively) exhibit characteristic impedances Z2. Each of the other two line sections in each of rings 44 and 46, line sections 7, 13, 8, and 14, exhibits characteristic impedances Zl and Z3 respectively that are cascaded over line sections 5 and 6 of length $\lambda_o/2$. Line section 5 and line section 6 each have characteristic impedance Z4. Thus, an inner mesh of four line branches with alternating characteristic impedances Zl and Z4 results and, for each ring 44 and 46, connection nodes 36 of the line branches with characteristic impedances Z2 and Z3 are connected to the ports 1, 2, 3, and 4 while maintaining double symmetry. Line feeder sections 50, 48, 52, and 54, each consisting of a cascade of, for example, three line sections, connects the rings 44 and 46 respectively to ports 1, 2, 3, and 4. As shown, line feeder section 50 is made up of line sections 15, 19, and 23. Line feeder section 48 is made up of line sections 16, 20, and 24 Line feeder section 52 is made up of line sections 17, 21, and 25, and line feeder section 54 is made up of lines sections 18, 22, and 26. Each of the line sections 15 through 26 has length $\lambda_o/2$. Of course, in the simplest case, only one line section (15, 16, 17, 18) of length $\lambda_o/2$ might be used to connect the rings 44 and 46 respectively to ports 1, 2, 3, and 4.

Optionally, to one or more of the connection nodes 35 between the line sections of length $\lambda_o/2$, or between each of the last $\lambda_o/2$-long- line sections with the ports, there is connected in parallel a cascade consisting of an even number of segments 27, 28, 29, 30 one-fourth a wavelength long. The last line section of length $\lambda_o/4$ forms an open circuit on the exposed end, or a cascade consisting of an uneven number made of line sections 31, 32, 33, 34 one-fourth a wavelength long, and the last of these line sections of length $\lambda_o/4$ is short-circuited or grounded on the exposed end.

Figure 2:
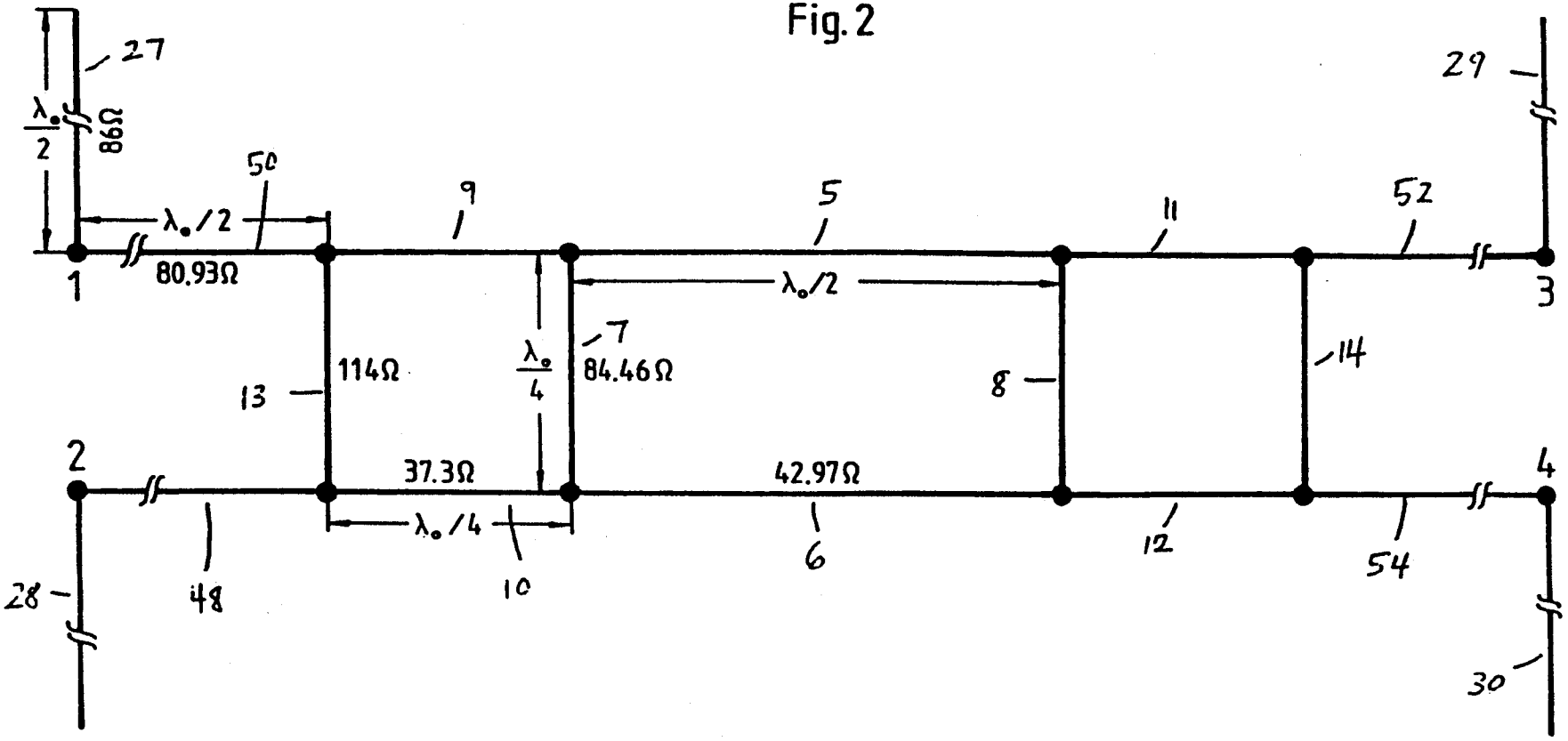
FIG. 2 illustrates an embodiment of the invention for a 1:1 power division.

FIG. 2 shows an embodiment of the wide-band branch line coupler according to the invention for a 1:1 power distribution. Here the cascaded feeder sections 48, 50, 52, and 54 described with reference to FIG. 1 are reduced to a single line section of length $\lambda_o/2$ for each port 1, 2, 3, and 4. Additionally, connected in parallel to the above, is a cascade for each port that is open-circuited on the end made of two line sections with length $\lambda_o/4$ of the same characteristic impedance.

Figure 3:
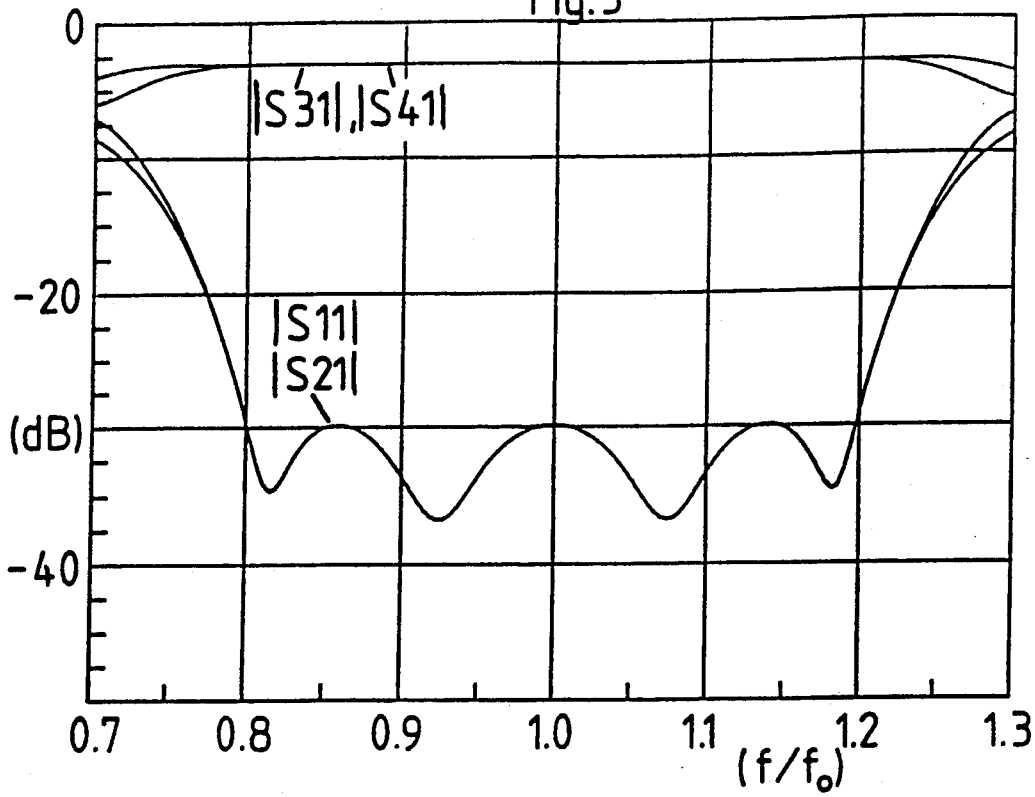
FIGS. 3–5 show the results of a network analysis of the coupler according to FIG. 2.

FIG. 3 shows the results of a network analysis of the network according to FIG. 2. Here the values of the S parameters S11, S21, S31 and S41 in dB for each of the four ports 1, 2, 3, and 4 respectively are plotted over the relevant frequency. Across a bandwidth of 40% relative to the central frequency $f_o$there is a matching of the input port 1 as shown by S11 of less than −30dB and an isolation of the isolated port 2 as shown by parameter S21 of at least −30 dB.

Figure 4:
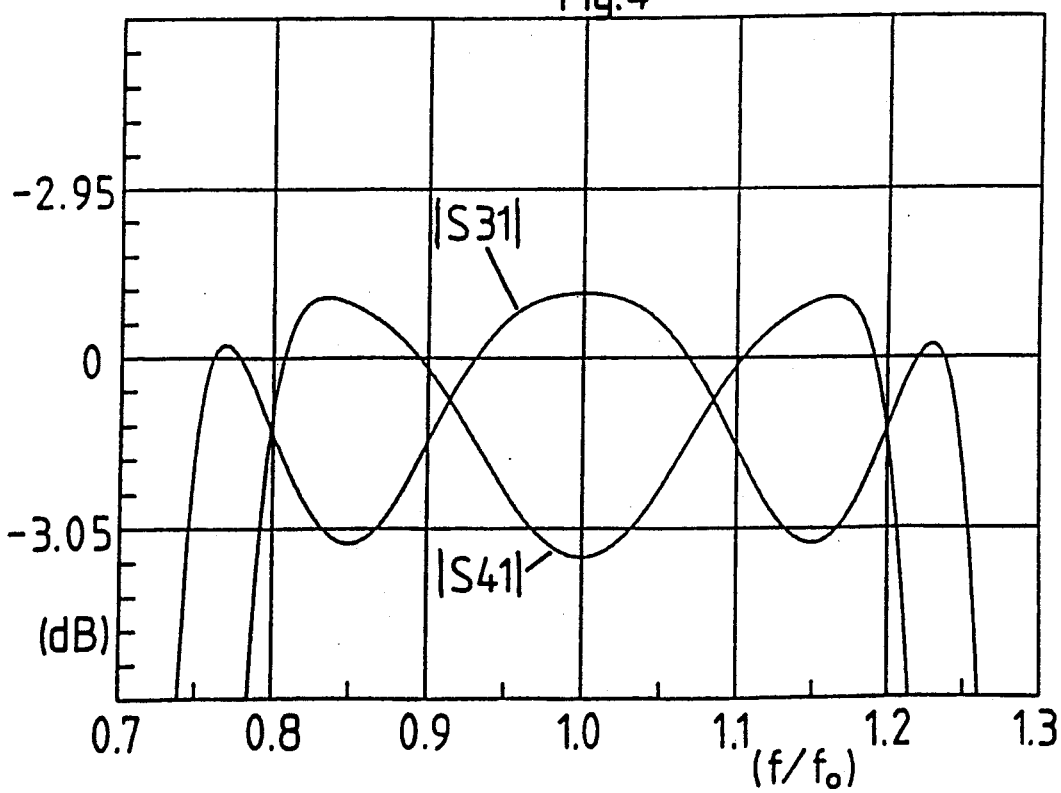
Figure 5:
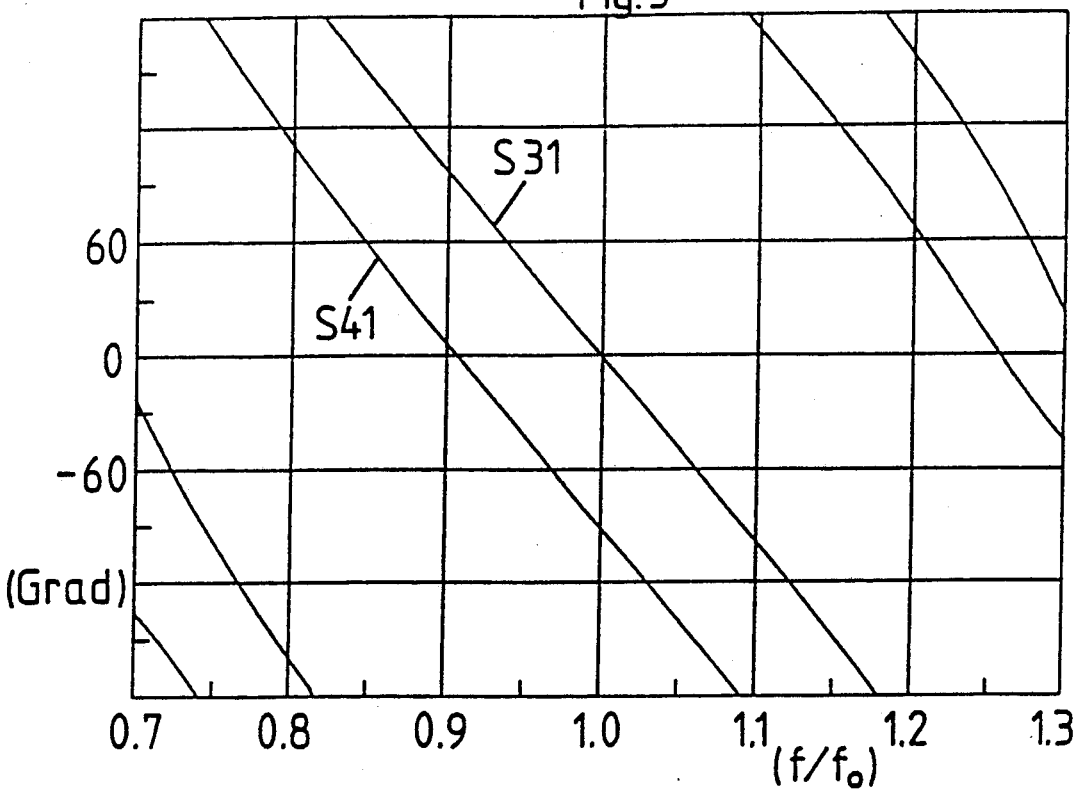

FIGS. 4 and 5 show the results of a network analysis of the network according to FIG. 2 for the S parameters S31 and S41 relating to ports 3 and 4. As can be seen in FIG. 4, over a bandwidth of 40% relative to central frequency $f_o$ the −3.01 dB condition, which corresponds to a power distribution of 1:1, is maintained with a deviation between -0.05 dB and +0.03 dB. The phases of S31 and S41 over the relevant frequencies are plotted in FIG. 5.

Figure 6:
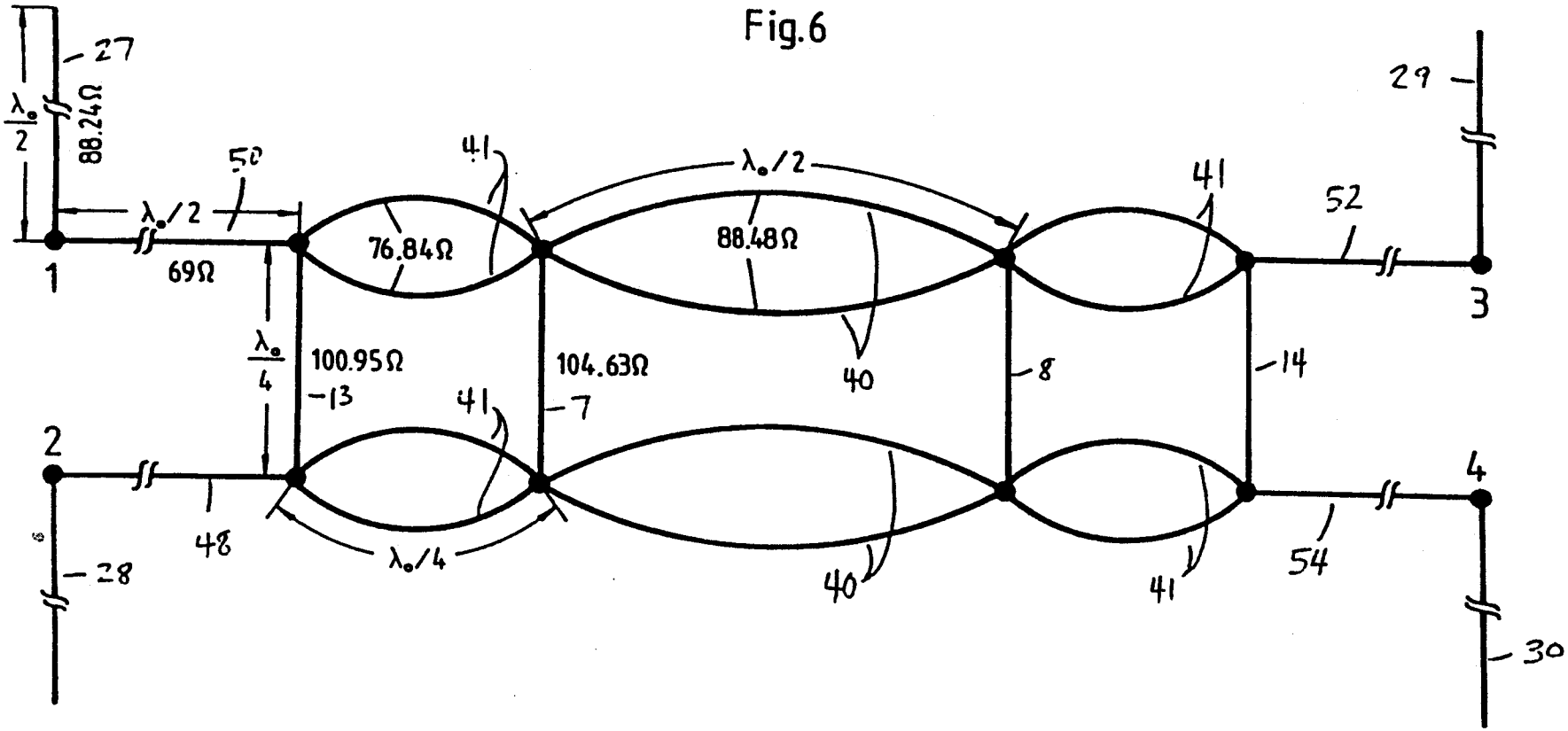
FIG. 6 illustrates another embodiment of the invention for a 1:1 power division.

FIG. 6 shows an embodiment of the wide-band branch line coupler according to the present invention with the same structure and power distribution as in FIG. 2, but dimensioned for larger bandwidths. Further, here line sections 5 and 6 are replaced by a parallel connection of two equally long line sections 40 of twice the characteristic impedance of line sections 5 and 6. Similarly, the line sections 9, 10, 11 and 12 of rings 44 and 46 respectively as shown in FIG. 2 have been replaced by parallel connections of line sections 41. In the example shown, two line sections 41, each with twice the desired characteristic impedance for the section, are connected in place of line sections 9 through 12 (shown in FIG. 2). These measures can be advantageous, for example for the practical construction of the coupler in microstrip technology, because production of low-resistance line sections in this technology can have a negative effect beyond a certain strip width because of the propagation capacity of higher modes. Thus, in FIG. 6, while maintaining double symmetry, line sections 5, 6, 9, 10, 11 and 12, with characteristic impedance $Z_i$ and a given electrical length are replaced by an arbitrarily-chosen number n of parallel-connected line sections 40 or 41 with characteristic impedances $Z_l \ldots Z_n$ and the same electrical length so that the ratio $1/Z_i = 1/Z_1 + \ldots + 1/Z_n$ holds for the characteristic impedances. Other line sections could be similarly replaced if desired.

Figure 7:
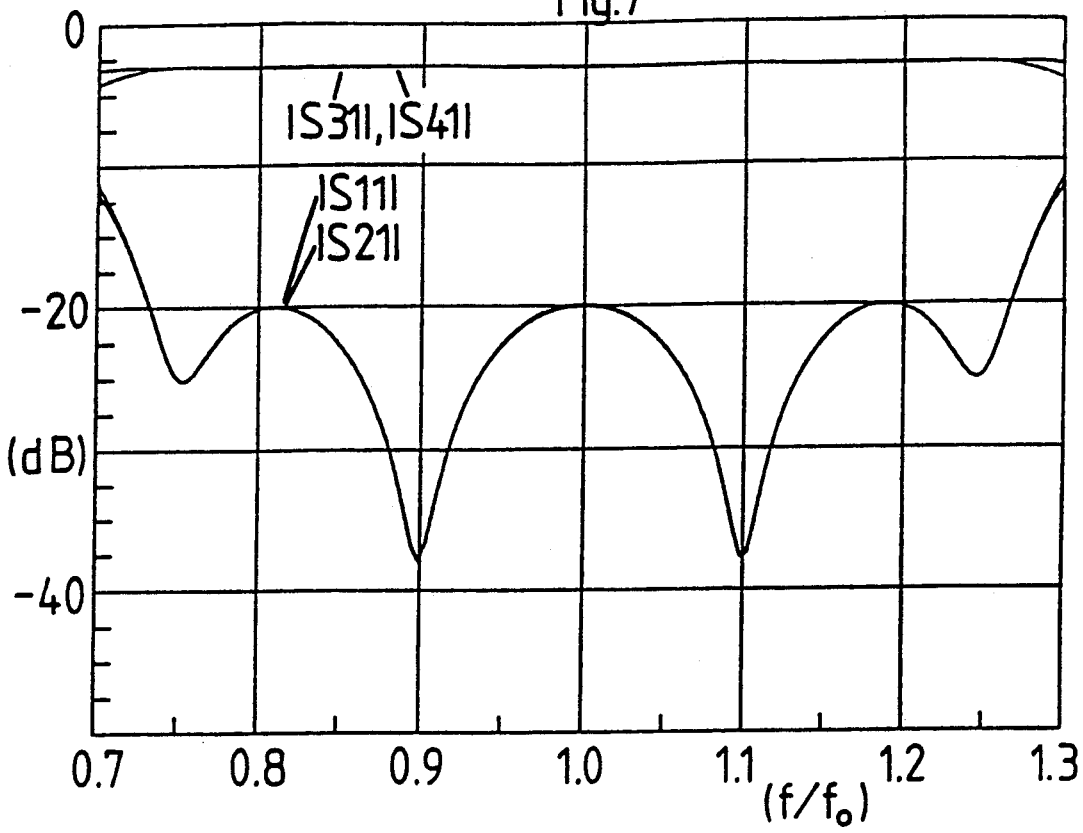
FIG. 7 shows the results of a network analysis of the coupler according to FIG. 6.

FIG. 7 shows the results of a network analysis of the network according to FIG. 6. Over a bandwidth of 53% of $f_o$ there is a matching of the input port 1 (S11) of less than −20dB, and the isolation of the isolated port of S21 is at least −20dB. Over this bandwidth, the −3 dB condition for the values of S parameters S31 and S41 relating to ports 3 and 4 is maintained with a maximum deviation of −0.2 dB.

Figure 8:
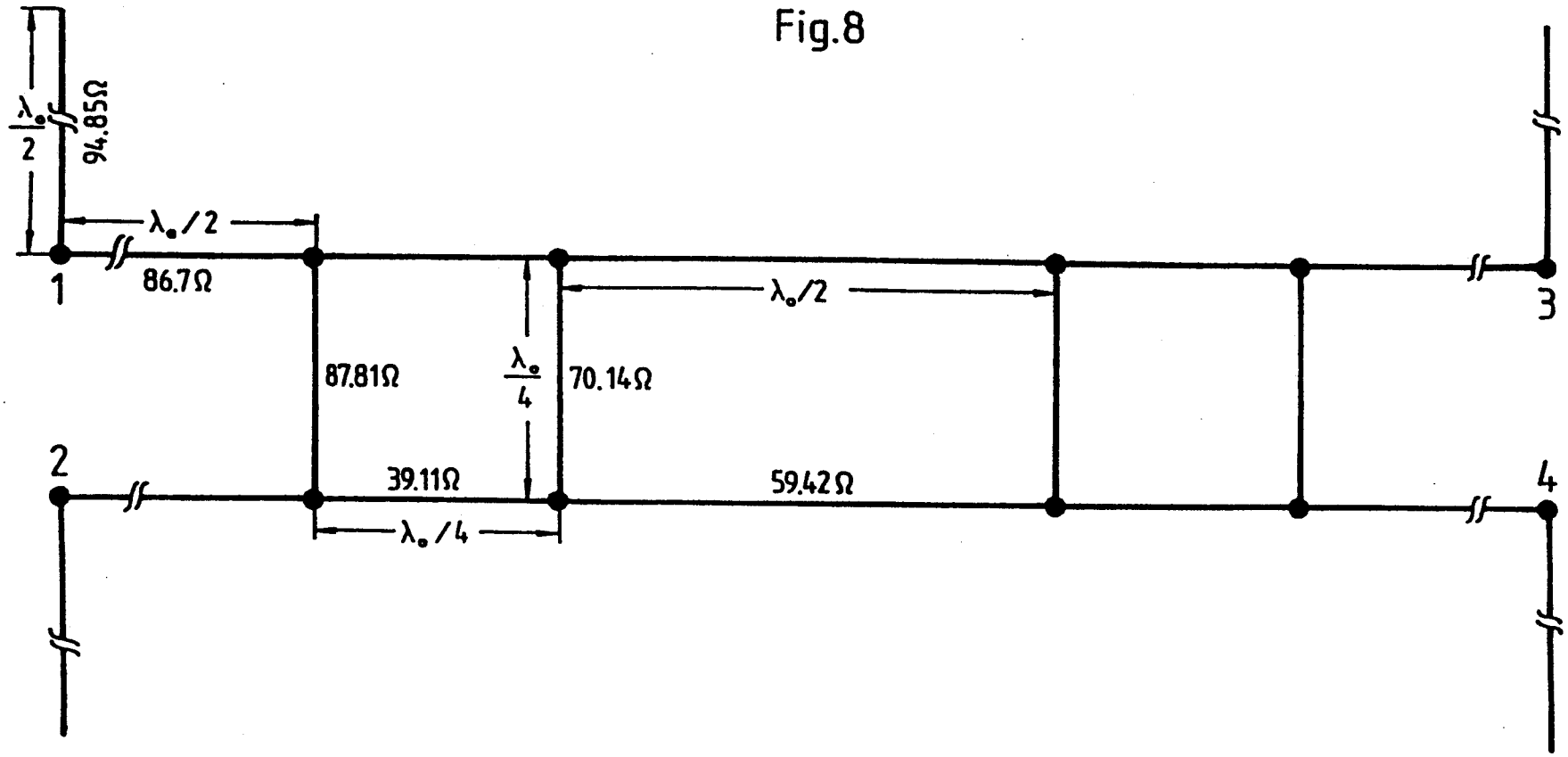
FIG. 8 illustrates an embodiment of the invention for a 1:3 power division.
Figure 9:
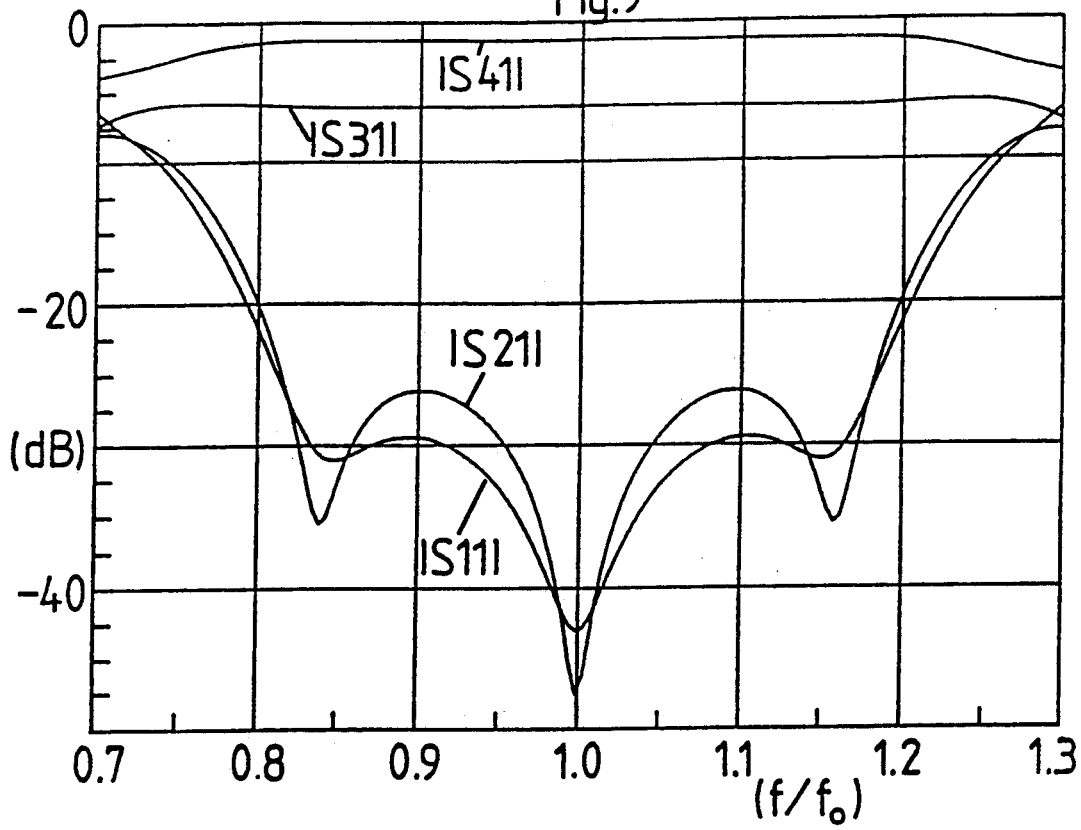
FIG. 9 shows the results of a network analysis of the coupler according to FIG. 8.

FIG. 8 shows an embodiment of the wide-band branch line coupler according to the invention with the same structure as in FIG. 2, but with the impedances of the line sections appropriately modified to produce a power distribution factor of 1:3. FIG. 9 shows the results of a network analysis of the circuit of FIG. 8.

Figure 10:
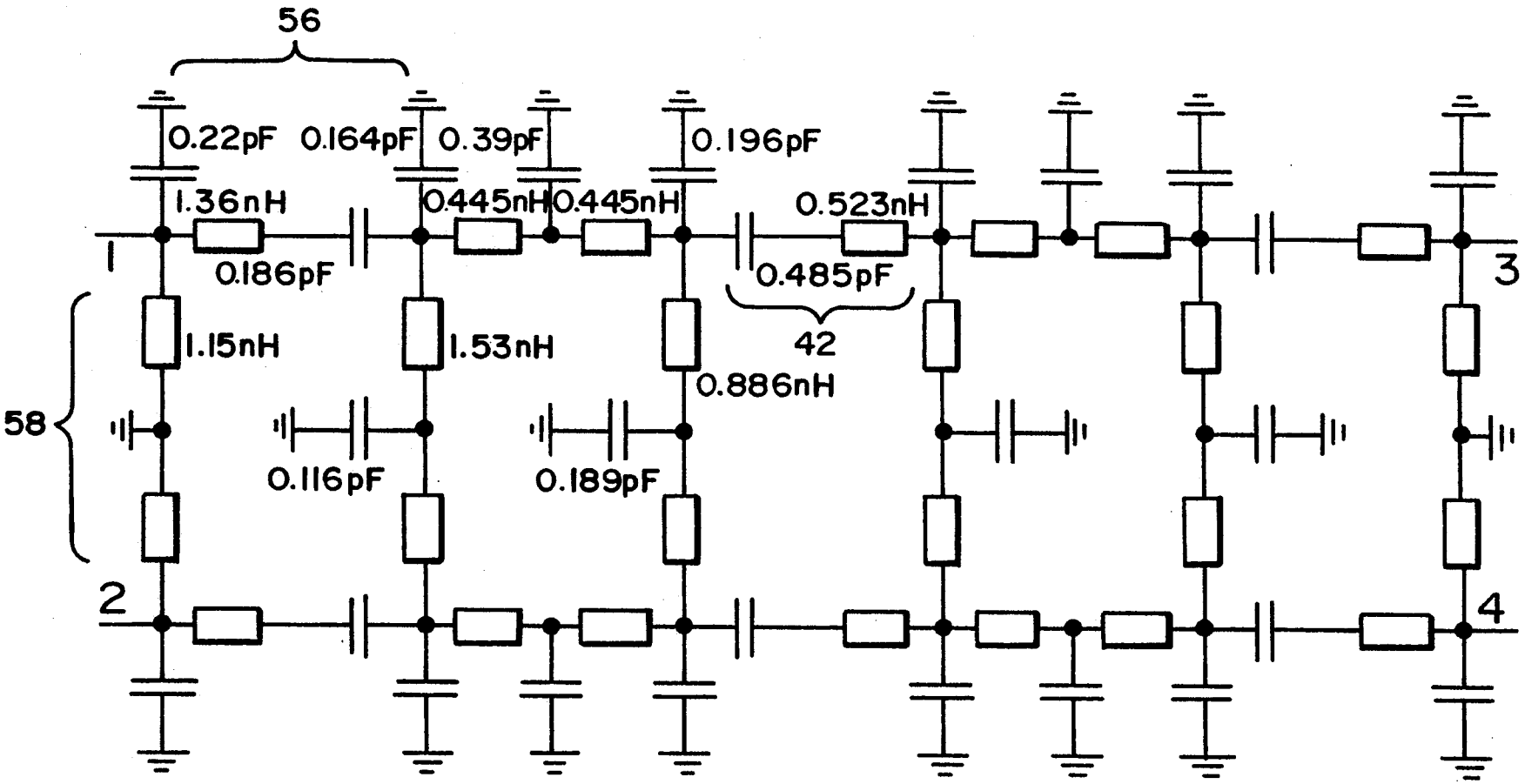
FIG. 10 depicts an embodiment of an advantageous further development of the invention.

FIG. 10 shows an advantageous further development of the wide-band branch line coupler according to the present invention. In this embodiment, selected line sections are replaced by equivalent circuits made up of concentrated elements. Here, starting from the structure disclosed in FIG. 2, the line sections of length $\lambda_o/4$ forming rings 44 and 46 (7, 9, 10, 13 and 11, 8, 12, 14) are each replaced by a simple or multiple equivalence network. As shown, line sections 9, 10, 11, and 12 are each replaced by two inductance elements of 0.445 nH. Appropriate capacitance filter devices between the terminals of the inductance elements and ground are provided as shown in the drawing figure. The line section 5 and 6 of length $\lambda_o/2$ connecting the rings are each replaced by a series resonant circuit 42 comprising a 0.485 pF capacitance and a 0.523 nH inductance in series.

The connecting feeder sections of length $\lambda_o/2$ shown in FIG. 2 at 48, 50, 52, and 54 are also replaced by series resonant circuits 56 comprising a 1.36 nH inductance in series with a 0.186 pF capacitance. The inductance and capacitance elements of sections 5, 6, 48, 50, 52, and 54 are each provided at their terminals with appropriate capacitances connected between the terminals and ground. The open-circuit individual branch circuits of length $\lambda_o/2$ were each replaced by an parallel resonant 58 comprising capacitances and inductances as shown in the drawing figure. By constructing the circuit with concentrated elements, it is possible to use it in integrated microwave circuits, such as microwave monolithic integrated circuits (MMICs).

Figure 11:
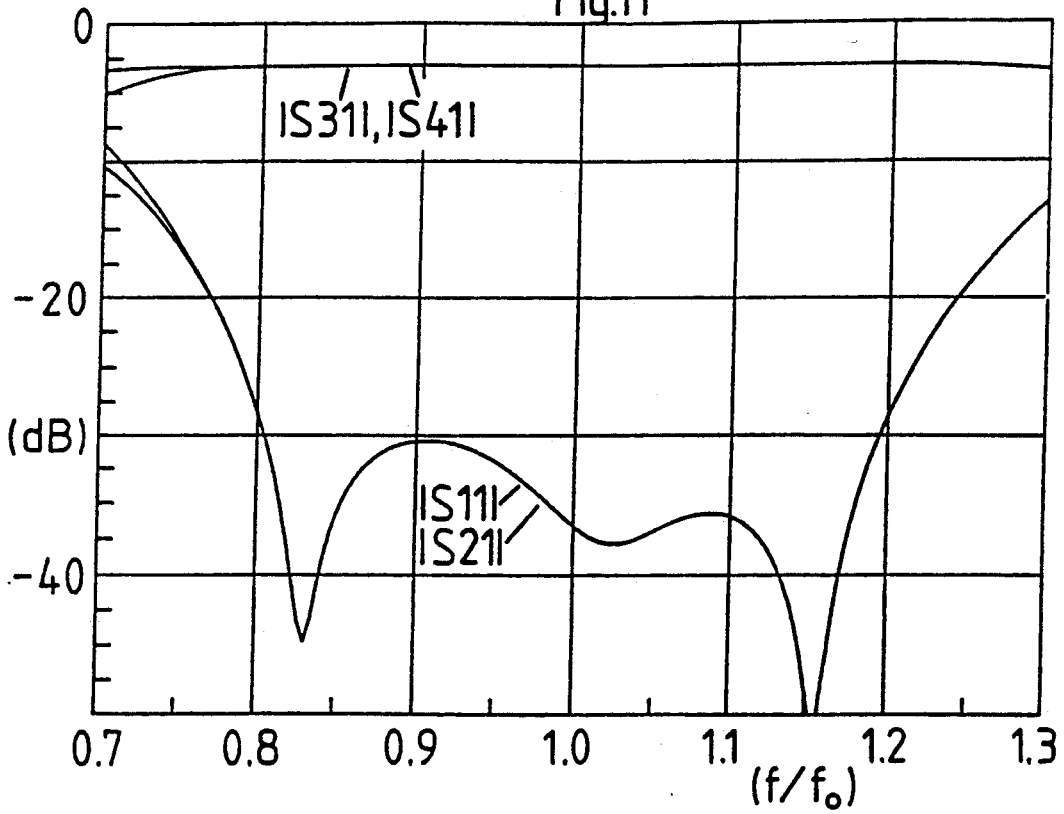
FIG. 11 shows results of a network analysis of the coupler according to FIG. 10.

FIG. 11 shows the results of a network analysis of the resulting circuit. To match input port 1 (S11) and the isolation of isolated port 2 (S21), values of Sll less than −30 dB and S21 less than −30 dB result over a bandwidth of 38%. The maximum deviation from the −3 dB condition over this bandwidth is about plus or minus 0.05 dB.

Figure 12:
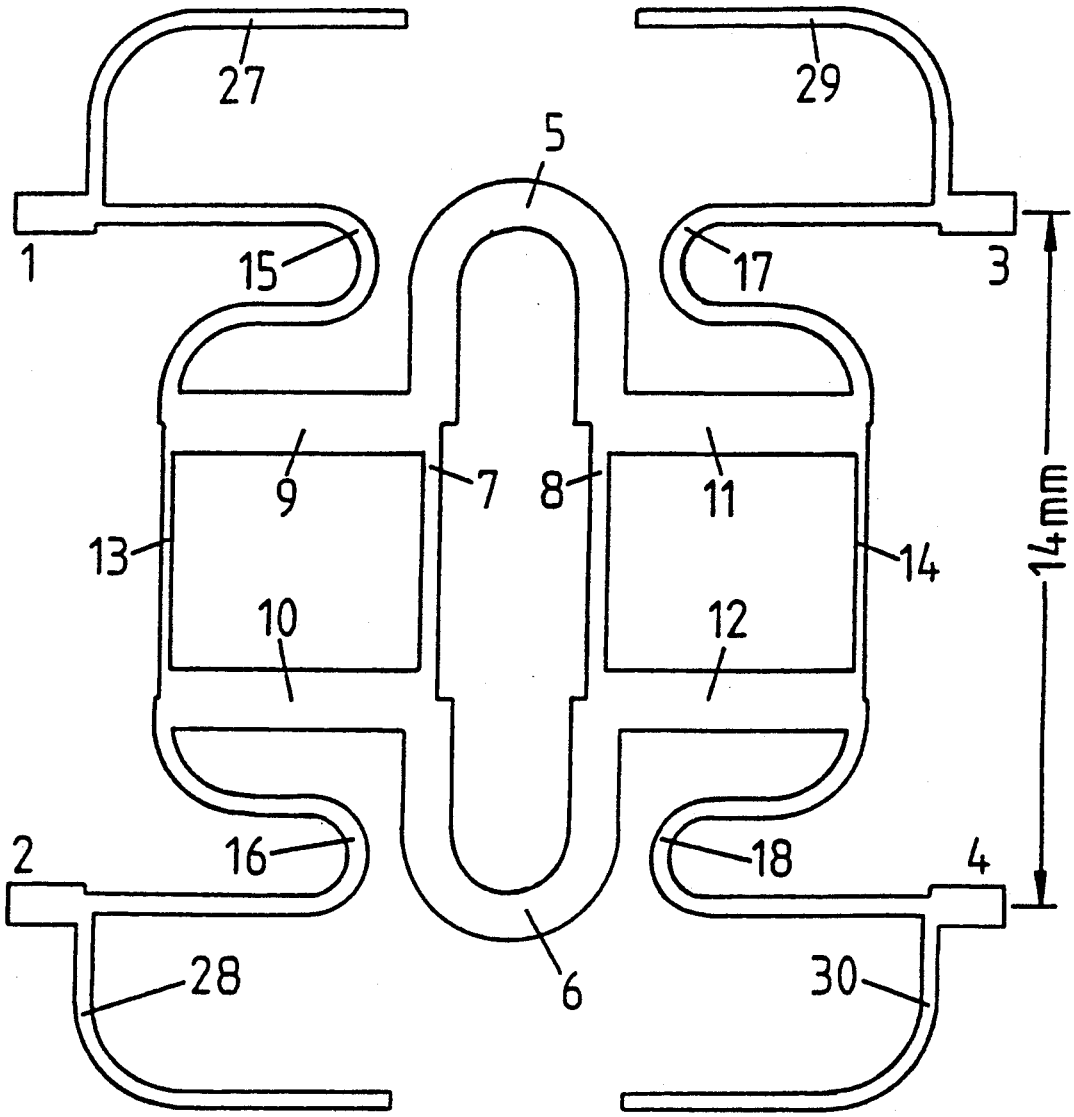
FIG. 12 illustrates a suitably produced embodiment of the coupler according to FIG. 2.

FIG. 12 shows a suitably produced embodiment of the wide-band branch line coupler according to FIG. 2 for a frequency range of 8 GHz–12 GHz in microstrip technology. A tetrafluoroethylene substrate with a thickness of 0.254 mm and a relative dielectric constant 2.2 may be used in constructing the preferred embodiment of the invention.

We claim:

1. A wideband branch double symmetrical four-port line coupler matched on all sides for operation in the microwave and millimeter wave range, which distributes a signal fed in by a first port in any ratio that is constant over the entire bandwidth to a second and third port with a phase difference of 90', so that a remaining fourth port is isolated, comprising:

two identical rings each constructed from four line means of length $\lambda_0/4$, where the wavelength at a midband frequency $f_o$ is designated by $\lambda_o$, connected one to one at four connection nodes, such that a first pair of opposite line means in the identical rings each have a characteristic impedance Z2 and a second opposite pair of line means in the identical rings have characteristic impedances Z1 and Z3 respectively;

two ring connecting means for connecting one connection node of each identical ring to one connection node of the other ring, the ring connecting means each having a characteristic impedance Z4 so that an inner mesh of four line branches with alternating characteristic impedance Z1 and Z4 is formed; and feeder means connecting each one of two connection nodes of each ring to a respective one of each of the first, second, third, and fourth ports, each said feeder means comprising a plurality of line sections of length $\lambda_o/2$ connected in series and having a feeder node at each end of a line section;

wherein a cascade consisting of a plurality of line sections of length $\lambda_o/4$ is connected in parallel to at least one of the feeder nodes, with the last of said line sections short-circuited on an exposed end if there are an odd number of line sections in the cascade and open-circuited on the exposed end if there are an even number of line sections in the cascade.

2. A wide-band branch double symmetrical four-port line coupler matched on all sides for operation in the microwave and millimeter wave range, which distributes a signal fed in by a first port in any ratio that is constant over the entire bandwidth to a second and third port with a phase difference of 90°, so that a remaining fourth port is isolated, comprising:

two identical rings each constructed from four line means of length $\lambda_o/4$, where the wavelength at a midband frequency $f_o$ is designated by $\lambda_o$, connected one to one at four connection nodes, such that a first pair of opposite line means in the identical rings each have a characteristic impedance Z2 and a second opposite pair of line means in the identical rings have a characteristic impedances Z1 and Z3 respectively;

two ring connecting means for connecting one connection node of each identical ring to one connection node of the other ring, the ring connecting means each having a characteristic impedance Z4 so that an inner mesh of four line branches with alternating characteristic impedances Z1 and Z4 is formed; and feeder means connecting each one of two connection nodes of each ring to a respective one of each of the first, second, third, and fourth ports, each said feeder means comprising at least one line section;

wherein at least one of the line means have a characteristic impedance Z and a given electrical length and are formed from n parallel-connected line sections with characteristic impedances $Z_1 \ldots Z_n$ and the same electrical length so that the ratio $1/Z = 1/Z_1 + \ldots + 1/Z_n$ is true for the characteristic impedances involved in a manner having double symmetry.

3. A wide-band branch double symmetrical four-port line coupler matched on all sides for operation in the microwave and millimeter wave range, which distributes a signal fed in by a first port in any ratio that is constant over the entire bandwidth to a second and third port with a phase difference of 90°, so that a remaining fourth port is isolated, comprising:

two identical rings each constructed from four line means of length $\lambda_o/4$, where the wavelength at a midband frequency $f_o$ is designated by $\lambda_o$, connected one to one at four connection nodes, such that a first pair of opposite line means in the identical rings each have a characteristic impedance Z2 and a second opposite pair of line means in the identical rings have characteristic impedances Z1 and Z3 respectively;

two ring connecting means for connecting one connection node of each identical ring to one connection node of the other ring, the ring connecting means each having a characteristic impedance Z4 so that an inner mesh of four line branches with alternating characteristic impedances Z1 and Z4 is formed; and feeder means connecting each one of two connection nodes of each ring to a respective one of each of the first, second, third, and fourth ports, each said feeder means comprising at least one line section;

wherein the ring connecting means have a characteristic impedance Z and a given electrical length and are formed from n parallel-connected line sections with characteristic impedances $Z_1 \ldots Z_n$ and the same electrical length so that the ratio $1/Z = 1/Z_1 + \ldots + 1/Z_n$ is true for the characteristic impedances involved in a manner having double symmetry.

4. A wide-band branch line coupler according to claim 3, wherein at least one of the line means is formed from circuits made of lumped elements in a manner having double symmetry.

5. A wide-band branch double symmetry four-port line coupler matched on all sides for operation in the microwave and millimeter wave range, which distributes a signal fed in by a first port in any ratio that is constant over the entire bandwidth to a second and third port with a phase difference of 90°, so that a remaining fourth port is isolated, comprising:

two identical rings each constructed from four line means of length $\lambda_o/4$, where the wavelength at a midband frequency $f_o$ is designated by $\lambda_o$, connected one to one at four connection nodes, such that a first pair of opposite line means in the identical rings each have a characteristic impedance Z2 and a second opposite pair of line means in the identical rings have characteristic impedances Z1 and Z3 respectively, and wherein at least one of the line means is formed from circuits made of lumped elements in a manner having double symmetry;

two ring connecting means for connecting one connection node of each identical ring to one connection node of the other ring, the ring connecting means each having a characteristic impedance Z4 so that an inner mesh of four line branches with alternating characteristic impedances Z1 and Z4 is formed and such that the ring connecting means comprise an equivalence network formed from circuits made of lumped elements in a manner having double symmetry; and feeder means connecting each one of two connection nodes of each ring to a respective one of each of the first, second, third, and fourth ports, each said feeder means comprising a plurality of line sections of length $\lambda_o/2$ connected in series and having a feeder node at each end of a line section.

6. The coupler of claim 5, wherein a cascade consisting of an even number line sections of length $\lambda_o/4$ is connected in parallel to at least one of the feeder nodes, and wherein the last of these line sections forms an open circuit on an exposed end.

7. The coupler of claim 5, wherein a cascade consisting of an uneven number of line sections of length $\lambda_o/4$ is connected in parallel to at least one of the feeder nodes, and wherein the last of these line sections is short-circuited on an exposed end.

8. The coupler of claim 5, wherein at least one of the line means have a characteristic impedance Z and a given electrical length and are formed from n parallel-connected line sections with characteristic impedances $Z_1 \ldots Z_n$ and the same electrical length so that the ratio $1/Z = 1/Z_1 + \ldots + 1/Z_n$ is true for the characteristic impedances involved in a manner having double symmetry.

9. The coupler of claim 5, wherein the line means comprise at least one equivalence network having a plurality of elements; the ring connecting means are series resonant circuits; and the feeder means are parallel resonant circuits.

10. The coupler of claim 5, wherein the ring connecting means have a characteristic impedance Z and a given electrical length and are formed from n parallel-connected line sections with characteristic impedances $Z_1 \ldots Z_n$ and the same electrical length so that the ratio $1/Z = 1/Z_1 + \ldots + 1/Z_n$ is true for the characteristic impedances involved in a manner having double symmetry.

11. The coupler of claim 10, wherein at least one of the line means is formed from circuits made of lumped elements in a manner having double symmetry.

12. The coupler of claim 15, wherein the feeder means are parallel resonant circuits.

* * * * *